United States Patent [19]

Josefsson

[11] Patent Number: 4,537,120

[45] Date of Patent: Aug. 27, 1985

[54] SURFACE TREATMENT PLANT AND A METHOD OF VENTILATING SAME

[75] Inventor: Leif Josefsson, Torpsbruk, Sweden

[73] Assignee: Flakt Aktiebolag, Nacka, Sweden

[21] Appl. No.: 486,736

[22] Filed: Apr. 20, 1983

[30] Foreign Application Priority Data

Apr. 30, 1982 [GB] United Kingdom ..... 8212649

[51] Int. Cl.[3] ..... F24F 11/00

[52] U.S. Cl. ..... 98/115.2; 55/DIG. 46

[58] Field of Search ..... 98/33 R, 36, 115 SB, 98/115 LH; 55/DIG. 46, DIG. 29, 340, 224; 261/120

[56] References Cited

U.S. PATENT DOCUMENTS 2,589,149 3/1952 Schneible et al. ..... 55/224 X
3,168,031 2/1965 Wilhelmsson et al. .
4,048,912 9/1977 Walker .
4,173,924 11/1979 Bradshaw ..... 98/115 SB
4,237,780 12/1980 Truhan ..... 55/DIG. 46 X
4,295,866 10/1981 Kearny ..... 98/115 SB X
4,351,863 9/1982 Roesner ..... 98/115 SB X

*Primary Examiner*—William E. Wayner
*Assistant Examiner*—John Sollecito
*Attorney, Agent, or Firm*—Dann, Dorfman, Herrell and Skillman

[57] ABSTRACT

A paint spray booth enclosure has separate zones defined by air curtains, one zone being polluted differently than another. A separate flow of ventilating air is passed through each zone. Each zone has its own separator for cleaning exiting air of its pollutant. In the illustrated embodiments, the outer zones have dry separators and the central zone has wet separator. Suitable conduits permit total or partial recirculation of the cleaned air, or total exhaust of the air to the atmosphere. Fresh outside air may be supplied to the ventilating flows along with spent ventilating air from the plant. Suitable controls for the air are provided.

11 Claims, 3 Drawing Figures

20
5
52
37
21
22
45
23
18
19
19'
39
40
41
42
13'
51
6A'
7
6B'
6A'
6
1
24
8
25
9
8
26
6A
$p_A$
$p_B$
6B
6A
$p_A$
47
53
54
55
10
3
10
11
11
46
36
A
B
A
2
17
34
12
4
15
15
27
28
35
13
16
13
38
31
29
14
30
17
34
32
33
38

20
5
52
37
18
19
19'
21
23
22
45
39
40
41
42
13'
50
6A'
7
6B'
6A'
48
43
6
1
48
8
8
24
25
26
$p_A$
$p_B$
$p_A$
6A
9
6B
6A
47
49
49'
10
10
3
46
11
11
B
A
A
36
2
17
38
34
12
4
15
15
28
27
16
13
13
35
29
14
30
31
38
17
34
32
33
38

20
5
52
21
23
22
18
19
48
44
39
40
41
42
45'
45
6A'
6B'
7
13'
48
6
1
24
25
26
8
9
$p_A$
$p_B$
6A
6B
47
49
49'
10
3
11
B
A
46
36
2
34
12
4
17
38
15
27
28
13
16
35
29
14
30
31
32
33

SURFACE TREATMENT PLANT AND A METHOD OF VENTILATING SAME

TECHNICAL FIELD

The invention relates to a surface treatment plant and a method of ventilating such a surface treatment plant.

It is to be understood that in this specification the expression surface treatment plant means a plant in which an object or objects to be surface treated and/or coated are placed in or conveyed through an elongated enclosure, either continuously or intermittently, and are surface treated and/or coated within said enclosure. For example, the enclosure may include means for liquid painting by brushing or spraying, the application of other surface coatings by such means, other operations such as powder-coating, scuffing and grinding, and other pretreatments and after-treatments including heating and cooling of products.

BACKGROUND ART

Paint spray booths often form part of a production line for the manufacture of products such as car bodies. Fully assembled or partly completed car bodies are usually conveyed by a conveyor into a room or tunnel forming the enclosure part of the booth and a desired color or colors is or are applied by spraying paint onto the bodies either manually or automatically. In manual spraying suitably clad personnel or operators working in the booth direct paint spray equipment towards the bodies which are to be painted; gases and fumes as well as paint sprays and mists, are released during the spraying operation and these are injurious to health. An effective ventilation system both for the personnel and for the effective operation of the booth is thus required.

It is also often desirable to be able to apply different colors or shades to different products passing through a booth. Therefore cross-contamination of colors should be avoided by preventing paint drifting from one spray station to another within the booth.

Various booths have been devised in an attempt to provide a paint spray booth which avoids the health hazards and provides for a control of the spraying operations. In prior booths there is an air inlet in the ceiling through which inlet very large quantities of air are conducted into the booth. This air exits from the booth through an outlet arranged in the floor or elsewhere, and the mist, fumes, paint, dust and the like are swept out of the booth by the air and are expelled simultaneously with the air. If the air inlet quantity is insufficient, it often tends to cause undesirable turbulence, and randomly directed air streams are generated which carry mist, fumes, paint, dust etc. throughout the booth. To avoid turbulence, the air is passed into the booth with a relatively high velocity. It will, however, be understood that a booth for painting, for example, car bodies has a relatively large volume. Such a booth might for example be 20–60 meters long, 5–6 meters wide and 3–5 meters high. The ventilation air will be conveyed in that at normal ambient working temperatures e.g. in the range 19° to 23° C. For health reasons fresh external air is normally used for the ventilation, so that in winter air at very low temperatures, for example −20° C., has to be increased in temperature to a temperate condition. Therefore it will be understood that enormous amounts of energy are required to provide the necessary high volume of relatively high-velocity temperate air over the whole of the booth from ceiling to floor. Also from a practical aspect it is not possible to ventilate differentially different parts of prior booths to any significant degree without physically partitioning the booths.

SUMMARY OF THE INVENTION

It is an object of the invention to seek to mitigate these disadvantages of the prior art.

According to one aspect of the invention there is provided a surface treatment plant having an enclosure as hereinbefore defined comprising means to supply ventilating air to the enclosure, means to provide at least one curtain of air to partition the enclosure into at least two zones extending over at least part of the enclosure within which zones the ventilating air passing through the enclosure entrains pollutant in the zones, the zones having different characters of pollution, for example one zone being more heavily polluted than the other zone, and separator means for each individual zone adapted to separate air and pollutant discharged from that zone.

According to a second aspect of the invention there is provided a method of ventilating a surface treatment plant as hereinbefore defined, comprising supplying ventilating air to the enclosure, providing at least one curtain of air to partition the enclosure into at least two zones extending over at least part of the enclosure within which zones the ventilating air passing through the enclosure entrains pollutant in the zones, and one zone being differently polluted than the other zone, and providing separator means for each individual zone and passing the air and pollutant from each zone to its respective separator means whereby air and pollutant from that zone are separated.

The separator means for air from the less heavily polluted zone may be a dry separator. This provides a simple yet efficient and inexpensive separator means.

The separator means for air from the more heavily polluted zone may be a wet separator. This provides an efficient means of separation.

The separator means for both zones may be adjacent the exit from the separate zones. This provides a compact structure in which the two separator means may be under a floor of the enclosure and permits cooperation between the two.

Alternatively or additionally, dry separator means may be provided adjacent the means to recirculate ventilating air into the enclosure.

The purified air exiting the respective separator means may be recirculated to the point and/or passed through heat recovery apparatus, and/or discharged to the atmosphere.

The purified air from the separator associated with one of the zones may be introduced as the ventilating air for another of the zones.

BRIEF DESCRIPTION OF THE DRAWINGS

A surface treatment plant in the form of a paint spray booth for painting vehicle bodies is hereinafter described, by way of example, with reference to the accompanying drawings, wherein.

DETAILED DESCRIPTION OF THE PREFERRED EMBODIMENTS

Figure 1:
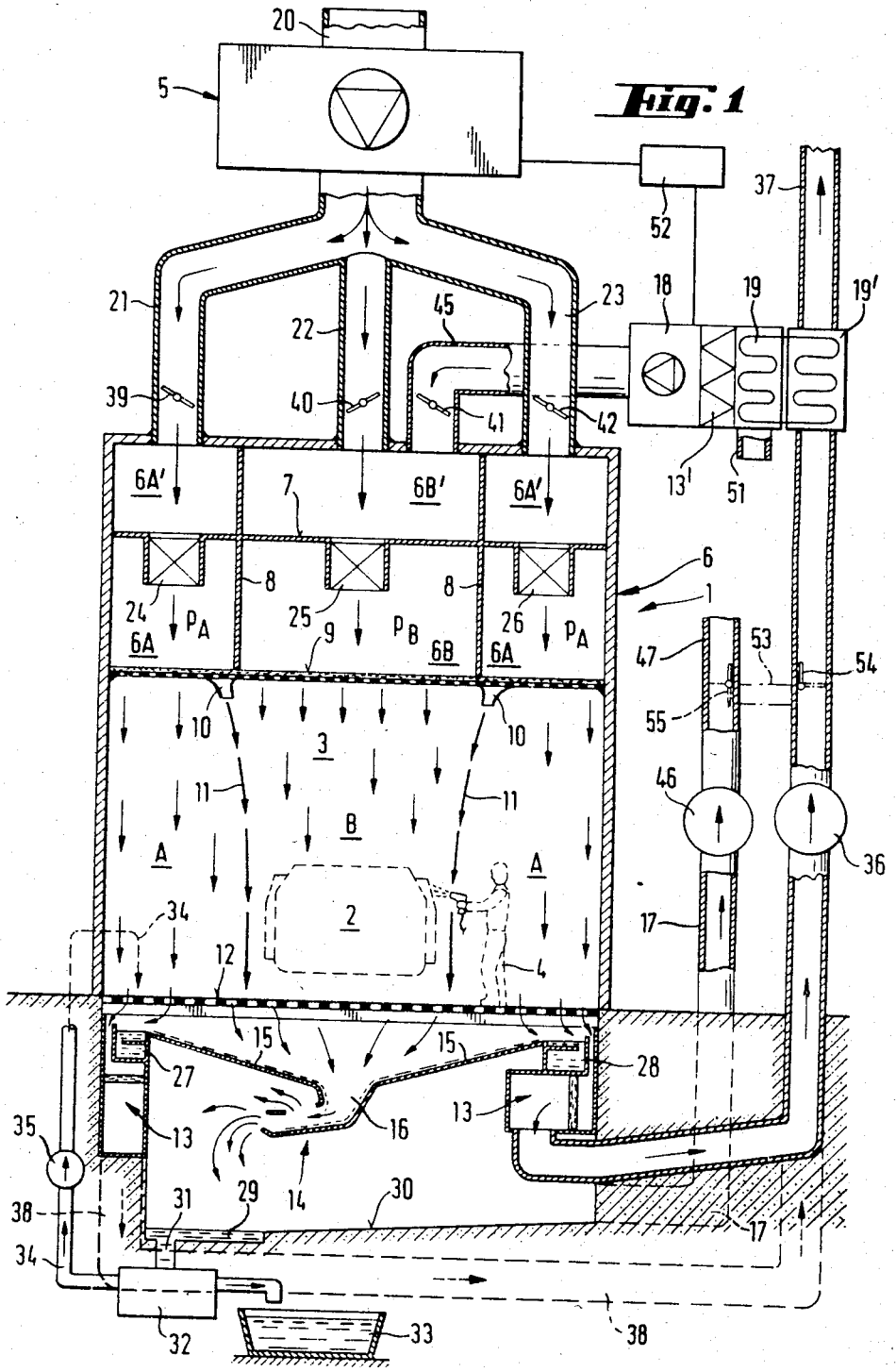
FIG. 1 shows a treatment plant with one embodiment of ventilation control means.

Referring to the drawing in all three figures, there is shown a paint spray booth 1 having an enclosure 3 in which a vehicle, in this case a car body 2, is painted by spray painting using an applicator wielded by an operator 4. Fresh ventilating air is supplied to the booth 1 from a fresh air supply means 5 comprising a fan or blower (not shown in detail) with an air inlet 20.

The booth 1 has downstream of the means 5 a plenum chamber 6 with an intermediate ceiling 7 and intermediate walls 8 which extend longitudinally and which divide the chamber 6 into three zones, a central zone and two lateral or side zones. These three zones are divided by the intermediate ceiling 7 into lower parts 6A, 6B and upper parts 6A', 6B'. The upper and lower parts communicate through flow-controlling air distributor inlets 24, 25 and 26 in order to get the desired pressures in the lower parts 6A, 6B and the desired air flows from the parts 6A and 6B into the enclosure 3. The flow into the upper parts 6A' and 6B' is achieved by branched conduits 21, 22, 23 from the air supply means 5 to the upper parts 6A', 6B' of the plenum chamber 6. In the conduits 21, 23 leading to the side parts 6A' there are provided valves 39, 42 for air flow control. Also in the central air conduit 22, there is a flow control valve 40. In addition to this, a return air conduit 45 with a control valve 41 leads to the central part 6B'. This will be further described below. By suitable adjustment of the damper valves 39, 42 and 40 and possibly 41, there is achieved a certain inlet pressure $P_A$ in the side parts 6A and another certain inlet pressure $P_B$ in the central part 6B. In the intermediate ceiling 7, the air distributor inlets 24, 25, 26 provide a more equalized air flow and air speed. Usually, the pressure $P_A$ in the side parts is lower than the pressure $P_B$ in the central part, as exemplified in the Figures.

The plenum chamber 7 is separated from the enclosure 3 by a ceiling 9 which is in the form of a filter. Adjacent the intermediate walls 8 of the plenum chamber 6 there are inlet nozzles 10 which receive air entering from the plenum chamber 7 and direct it into the enclosure at an increased velocity relative to the remainder of the entering air so as to provide curtains 11 of air which in the present instance, extend longitudinally over the longitudinal extent of the enclosure 3 and divide the enclosure into the three zones A, B, A which extend throughout the length of the enclosure 3. Beneath a perforated floor 12 of the enclosure 3 there are three separators, a dry separator 13 for each of the air flows out of the zones A and a wet separator 14 for the air flow out of the zone B. The wet separator 14 is of the conventional kind using water flooding over inclined plates 15 to a central slot 16 which gives a venturi-like action to mix the air and water exiting zone B and so separate pollutants from the air and transfer them to the water. The mixture which exits from the venturi slot 16 separates, with the air passing out through a conduit 17, and the pollutant-laden wash water falling to the floor 30.

Figure 2:
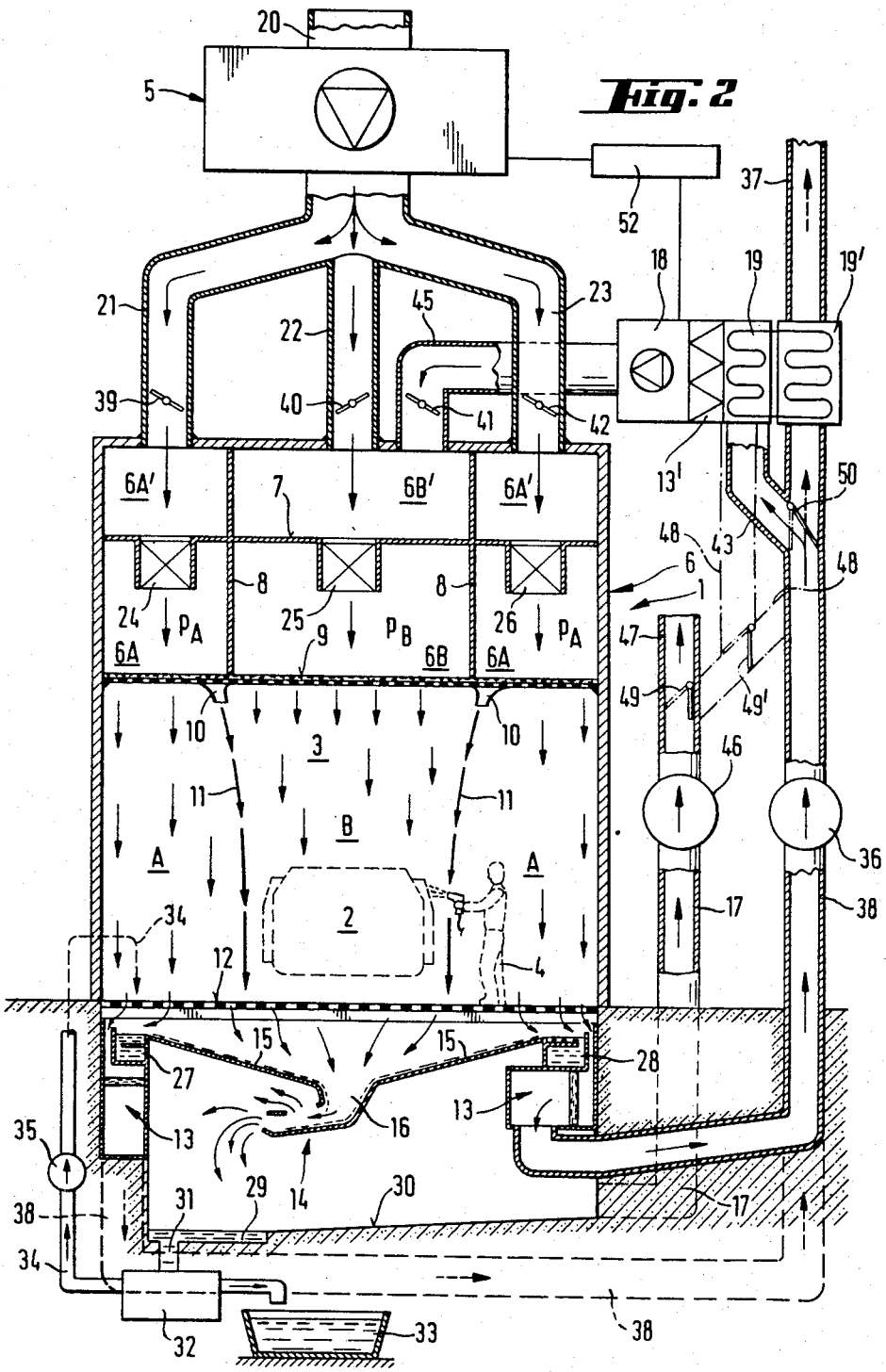
FIG. 2 shows a treatment plant with another embodiment of control means which permits selective heat and/or moisture recycling from the air in either or both of two different zones.
Figure 3:
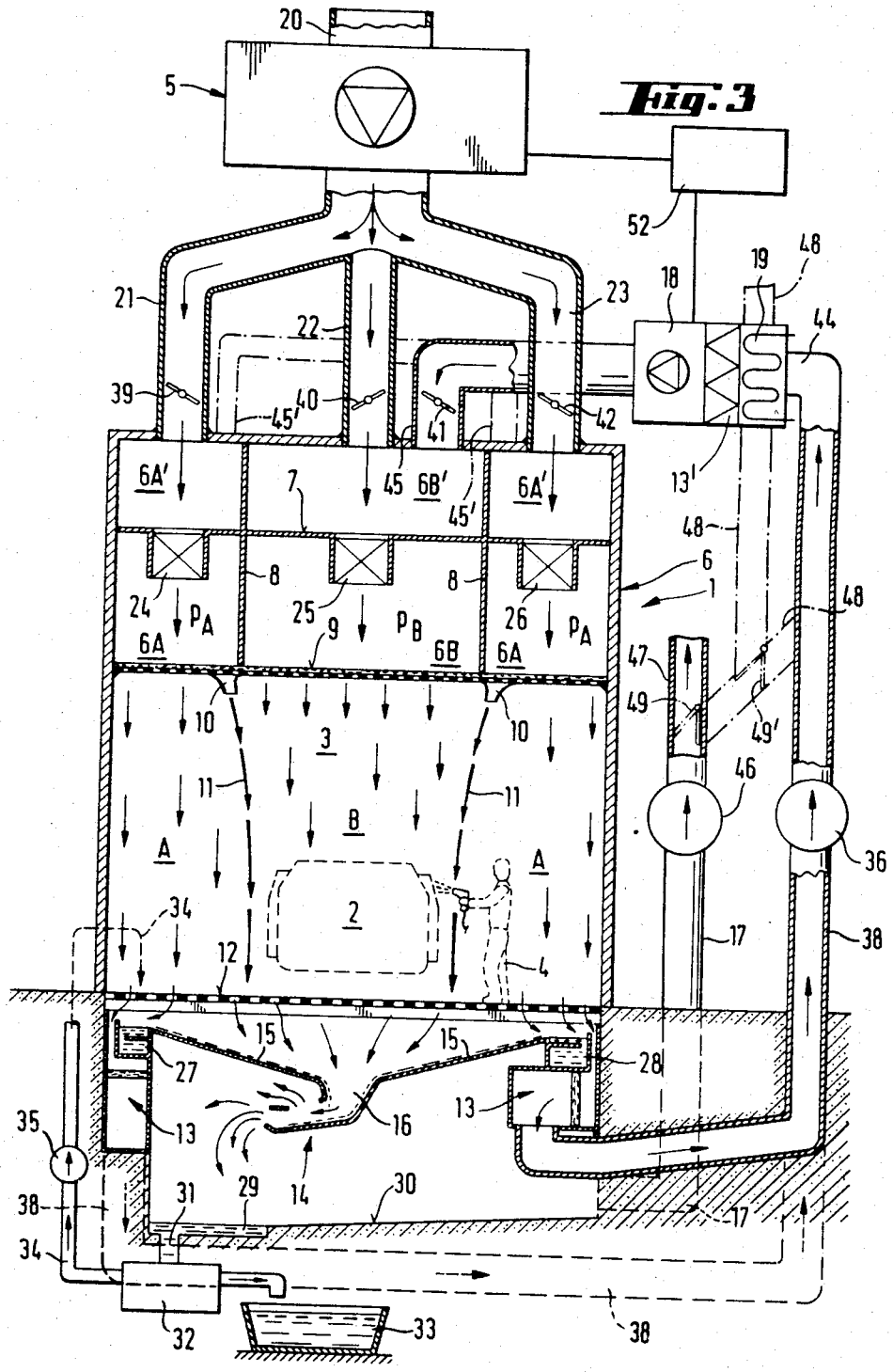
FIG. 3 shows a plant with a third embodiment of control means affording selective recycling of air from one zone and possibly from another zone.

In operation of the plant, the air in zone B is differently polluted than the air in zones A. In a paint booth, the air in zone B is more heavily polluted with paint particles than the air in the zones A because the curtains 11 of air from the nozzles 10, shown by heavy arrows in the Fig., prevent substantial cross-over of pollutants from the zone B to zones A. Thus, zone B confines the paint spray and zone A is without direct paint spray. Therefore, the air exiting from the zones A is not so heavily polluted as that from zone B. In other types of plant, the air in one zone may be dominantly polluted with particulate matter and the air in the other zone may be dominantly polluted with gaseous or vapor contaminants. In such case, a suitable separator is selected to handle the dominant pollutant in each zone. In the illustrated treatment plant, the dry separators 13 separate the air and entrained pollutant from zones A whereafter the air may be re-circulated to the booth 1 with ventilating air as shown in FIGS. 2 and 3. Alternatively, the air may be discharged to atmosphere as shown in FIG. 1. The air re-admitted to the booth may be admitted to either the zones A and the zone B as shown in FIG. 3, but in the embodiments illustrated in FIG. 2, it is recirculated zone B alone since it may contain potentially harmful solvents which should be kept away from the operators in zones A.

The air and entrained pollutant exiting the zone B is washed in the wet separator 14 so that the air is cleaned, and this air is either exhausted to atmosphere by the separate conduit 17, as indicated in FIG. 1 or 2, or is recirculated to the booth 1 after passage through heat exchange apparatus, as indicated in FIG. 2 or 3, so that it is heated from its exiting temperature of 14°–15° C. to which it is cooled by the water, to the entry temperature of about 22° C.

The wash water from the wet separator is collected in an underlying cavity with inclined floor 30 and a collecting basin 29. The latter is connected to discharge means 31, which transfer the wash water to a wash water separator 32, where the pollutants are extracted and discarded to a waste container 33. The cleaned wash water is recycled to the wet separator 14 by a return pipe 34 and a pump 35. The recycled wash water is transferred to flood boxes 27, 28, which overflow to the inclined plates 15 of the wet separator 14. In this way, it is possible to handle the wet separator wash water at least partially in a closed system, and thereby to reduce the discharge of contaminated water to the sewer system.

The dry separator 14 may consist of a single filter device in the entrances to the separator chamber 13 which removes pollutant material from the discharged air which exits through conduits 38. As shown, the dry separators are along opposite side edges of the wet separator and may handle contaminated ventilating air from zone B which is not exhausted through the venturi 16.

In a modification shown in FIG. 3, the exhaust from the dry separators 13 may be recirculated to the plenum chambers 6A' and 6B' and a second dry separator 13' may be located adjacent the entry of the ventilating air to the booth. In such case, the separation in the dry separators 13 may be unnecessary and the filter units in the chambers 13 may be eliminated.

There are several possible ways to conserve the energy in the air exhausted from the paint spray booth in zones A and/or B and FIGS. 1–3 show some of the modes to achieve this. In the embodiment shown in FIG. 1, the air from the wet separator 14 leaves through the conduit 17 by means of fan means 46 and is normally evacuated to the surrounding atmosphere through a direct air outlet means 47. The air from the dry separators 13 is evacuated through air conduit means 38 with the aid of fan means 36 and is discharged to the surrounding atmosphere by air outlet means 37. The air, before emerging from means 37, passes through a heat and/or moisture exchanger 19' transferring heat and/or moisture to the ventilating air fed into line 45. Cross-transfer conduit 53, air diversion flap valve 54 and 3-position flap valve 55 permit air from zone A and/or zone B to be selectively directed to either or both of the air outlet means 37 and 47.

Additional ventilating air for the paint spray booth 2 is provided by an additional supply means 18, preferably with dry separator means 13' and conditioning means 19, i.e. means for heating and/or cooling of the air, possibly as part of or coupled with the heat and/or moisture exchanger 19'. Such a unit is provided with air inlet means 51, which is connected to a suitable air source, for instance spent ventilation air leaving the building housing the paint spray booth, or the atmosphere in general. The use of spent ventilation air from the building reduces the need for substantial energy input to condition the recirculated air to the proper working and comfort levels within the enclosure 3.

In order to provide the paint spray booth 1 with a suitable mixture of fresh and recirculated air at the right temperature and moisture content, there is provided a regulating means 52 to control and adjust the fresh air supply means 5 and/or the recirculated air supply means 18. This regulating means may be operated automatically as well as by a hand-operated control means, such as a control panel in an operator's room. This regulating means 52 in FIG. 1 usually comprises more than one operating system and can be made to influence all the control means in the air supply system, such as flow control valves 39, 40, 41, and 42, distributor inlets 24, 25 and 26, air supply means 5 and 18, fan means 36 and 46, and cross-transfer flap valves 54 and 55.

FIG. 2 shows alternative modes which may be combined to recirculate air to the paint spray booth 1. The air outlet means 37 has a branch return air inlet 43 to the air recirculation system, and an air diversion flap valve 50, which can be positioned to either recirculate the air or discharge it to the atmosphere through the heat and/or moisture exchange means 19'. The figure also shows that it is possible to provide the air outlet means 47 with a branch air conduit 48, which merges with the branched return air inlet below the branch 43 or is directly connected to the conditioning means 19 or the dry separator 13' or the supply means 18 or separately to the heat and/or moisture exchange means 19'. The air conduit 48 is provided an air diversion flap valve 49 at its junction with the conduit 47, which can divert the air to any one of the units in the air recirculation system or to the atmosphere. The branched air conduit 48 may be forked with an air diversion flap valve 49' and the other means 19 or 13' or 18. All the valves 49, 49', and 50 may, of course, be positioned in any intermediate position, thus diverting only part of the air flow to the air recirculating system and means 19'.

FIG. 3 shows an air recirculation system, where all the air leaving zones A is directed to the air recirculation system by a return air inlet 44 positioned above the blower 36 in place of the outlet 37. From the air outlet means 47 connected to the wet separator 14, i.e. zone B, there may be a branch air conduit 48, which is connected to the air recirculation system inlet 44 and has air diversion flap valve(s) 49 and/or 49' to control the air flow as discussed in connection with FIG. 2. In FIG. 3, it is shown, that air is returned to the central part 6B' by means of return air conduit 45 and control valve 41. However, return air inlets 45' also return air to the side parts 6A'. The precondition for the latter is, of course, that the recirculated air does not contain any harmful ingredients such as excessive amounts of solvents.

The embodiments of the invention shown in FIGS. 2 and 3 provide very favorable opportunities to adapt the recirculation of air to the prevailing environment conditions. During the cold season it is expedient to return air from the dry separator with room temperature to the paint booth through the recirculation system. During warm periods it is more favorable to recirculate the air from the wet separator, because this air is cooled close to the dew point, when passing the wet separator. In addition to the control of the conditions of the recirculated air by choosing a suitable air stream from the wet and/or dry separator, the air is further conditioned in the conditioning means 19 for recirculated air, as well as in the separator means 13' and supply means 18, including such conditions as temperature, moisture, speed, pressure, and purity.

It will be understood that the air curtains 11 may be generated by providing suitable openings or inlets in the filter ceiling 9. However, the nozzles 10 are preferred because they may be moved or altered in position, so adjusting the position of the curtains, and thus the size or volume of zone B as desired.

It will also be understood that although two zones A and one zone B have been described, as many zones as desired can be provided, providing there is one zone A and one zone B which have different character or type of pollution, for example where one zone is more heavily polluted that another zone. In addition to partitioning the paint spray enclosure longitudinally by air curtains 11 as shown, it is possible to in the same way to partition the paint spray enclosure with transverse air curtains, in order to separate different operations in the paint spray booth and avoid cross contamination of dust and excess paint, which may miscolor products, which are treated in a different operation.

In every embodiment, the air exiting zones A and passing through dry separators 13 or 13' does not require to be reheated if it is recirculated to the booth. This is because the dry separators do not cool the air exiting from the booth, which remains at required ambient temperature for the booth. This is a source of energy saving as well as on cost of the installation and is therefore of technical advantage.

I claim:

1. A paint spray booth having an enclosure in which spray painting is effected, said enclosure having a ceiling providing a plenum chamber above said ceiling, openings through /said ceiling admitting ventilating air into said enclosure from said chamber, and partition means dividing said chamber into passageways and into the enclosure, said enclosure having a floor underlying said ceiling with a plurality of air exit means associated therewith, means adjacent the partition means to provide at least one curtain of air to partition the enclosure into at least two separate zones extending over at least part of the enclosure, said curtain extending from the ceiling adjacent said /partition means to the floor whereby each zone is supplied with air from a separate passageway, the air in one zone being polluted differently than the air in the other zone, a first of said plurality of exit means being at one side of said curtain to receive air from said one zone, a second of said plurality of exit means being at the other side of said curtain to receive air from said other zone, the ventilating air passing through each zone of the enclosure entraining the pollutant in said zone, a first separator means having a first fan means communicating with said first air exit means of the floor for receiving the ventilating air discharged from said one zone and adapted to separate the air and the pollutant discharged from that zone, and a second separator means having a second fan means communicating with said second exit means for receiving the ventilation air discharged from the other zone and adapted to separate the air and the pollutant discharged from that zone, said one zone being more heavily polluted with paint particles than the other zone, the first separator means being a wet separator and the second separator means being a dry separator.

2. A booth according to claim 1 including valve means to selectively direct the air from said dry separator into said ventilating air supply means for the passageway above the ceiling of said other zone.

3. A booth according to claim 1 including means to transfer at least one of moisture and heat to said ventilating air from the air discharged from said dry separator.

4. A booth according to claim 1 wherein said wet separator uses wash water to remove said paint particles from the ventilating air discharged from said one zone, and including means to collect said wash water, separate said removed paint particles and recirculate the cleansed wash water to said wet separator.

5. A booth according to claim 1 including nozzle means adjoining said ceiling in said enclosure and underlying said partition means to produce said air curtain.

6. A booth according to claim 1 wherein said ventilating air supply means comprises a first means supplying fresh air and a second means supplying recirculated air, and valve means to regulate the proportion of fresh and recirculated air in each of said inlet passageways.

7. A method of ventilating a paint spray booth having an enclosure in which spray painting is effected, said enclosure having a ceiling and a floor, comprising supplying ventilating air to the ceiling of the enclosure, providing at least one curtain of air extending between the ceiling and the floor to partition the enclosure into at least two separate zones extending over at least part of the enclosure, one zone adapted for effecting said painting and being more heavily polluted with paint particles than a second zone, said second zone adapted to be without direct paint spray, passing ventilating air through each zone in the enclosure from ceiling to floor to entrain the pollutant in said zone, providing a first exit slot adjacent said floor at one side of the curtain with at least one plate inclined toward an exit slot, and flooding said plate with water to intermix with air and pollutant from said one zone and to pass air and pollutant from said one zone to a first separator means having a first fan means in which the air and the pollutant from that zone are separated, providing a second exit in said floor at the other side of said curtain to pass into a second separator means having a fan means in which the pollutant from said second zone is separated from the exhaust air, and using the separated air from the second separator means for passing through said one zone.

8. A method according to claim 7 wherein said exhaust air from said second zone is passed through a dry separator.

9. A method according to claim 7 wherein said supplied ventilating air for the one zone is partly fresh air and partly recirculated air.

10. A paint spray booth having an enclosure in which spray painting is effected, said enclosure having a ceiling providing a plenum chamber above said ceiling, openings through said ceiling admitting ventilating air into said enclosure from said chamber, and partition means dividing said chamber into separate passageways, means to supply ventilating air to said passageways and into the enclosure, said enclosure having a floor underlying said ceiling with a plurality of air exit means associated therewith, means adjacent the partition means to provide at least one curtain of air to partition the enclosure into at least two separate zones extending over at least part of the enclosure, said curtain extending from the ceiling adjacent said partition means to the floor whereby each zone is supplied with air from a separate passageway, the air in one zone being polluted differently than the air in the other zone, a first of said plurality of exit means being at one side of said curtain to receive air from said one zone, a second of said plurality of exit means being at the other side of said curtain to receive air from said other zone, the ventilating air passing through each zone of the enclosure entraining the pollutant in said zone and a first separator means having a first fan means communicating with said first air exit means of the floor in each zone for receiving the ventilating air discharged from said one zone and adapted to separate the air and the pollutant discharged from that zone, and a second separator means having a second fan means communicating with said second exit means for receiving the ventilating air discharged from the other zone and adapted to separate the air and the pollutant discharged from that zone, one zone being arranged to confine paint spray therein so as to be heavily polluted with paint particles, and the other zone being without direct paint spray so as to be less heavily polluted than the one zone, the second separator means being a dry separator, and including means to recirculate air from said dry separator to the ventilating passageway above the ceiling of said one zone.

11. A booth according to claim 10 having means to provide two air curtains on opposite sides of the center of the booth, said first exit means being a central slot positioned centrally of the floor and including upwardly and outwardly inclined plates, and means to flood water over said plates and into said slot, and the second exit means comprising an exit slot adjacent each wall of said booth.

* * * * *

UNITED STATES PATENT AND TRADEMARK OFFICE

CERTIFICATE OF CORRECTION

PATENT NO. : 4,537,120

DATED : August 27, 1985

INVENTOR(S) : Leif Josefsson

It is certified that error appears in the above-identified patent and that said Letters Patent is hereby corrected as shown below:

Column 2, line 51, delete "point" and insert --plant--.

Claim 1, line 6, after "into" (first occurrence) insert --separate passageways, means to supply ventilating air to said--.

Signed and Sealed this

*Nineteenth* Day of *November 1985*

[SEAL]

*Attest:*

DONALD J. QUIGG

*Attesting Officer*

*Commissioner of Patents and Trademarks*